US008894436B2

(12) United States Patent
Su

(10) Patent No.: US 8,894,436 B2
(45) Date of Patent: Nov. 25, 2014

(54) EXPANDABLE POWER CONNECTOR

(71) Applicant: Chuan-De Su, Xinbei (TW)

(72) Inventor: Chuan-De Su, Xinbei (TW)

( * ) Notice: Subject to any disclaimer, the term of this patent is extended or adjusted under 35 U.S.C. 154(b) by 19 days.

(21) Appl. No.: 13/678,310

(22) Filed: Nov. 15, 2012

(65) Prior Publication Data

US 2013/0137302 A1 May 30, 2013

(30) Foreign Application Priority Data

Nov. 28, 2011 (TW) ..... 100143461 A

(51) Int. Cl.

| | |
|---|---|
| ***H01R 13/72*** | (2006.01) |
| ***H01R 12/70*** | (2011.01) |
| ***H01R 25/00*** | (2006.01) |
| *H01R 24/76* | (2011.01) |
| *H01R 13/713* | (2006.01) |

(52) U.S. Cl.

CPC ..... *H01R 12/7088* (2013.01); *H01R 24/76* (2013.01); *H01R 13/713* (2013.01); *H01R 25/006* (2013.01)

USPC ..... 439/501; 439/650

(58) Field of Classification Search

CPC ..... H01R 31/02; H01R 31/06; H01R 13/60; H01R 13/72; H01R 25/003; H01R 25/006

USPC ..... 439/501, 502, 650, 651, 652

See application file for complete search history.

(56) References Cited

U.S. PATENT DOCUMENTS

| | | | | |
|---|---|---|---|---|
| 3,359,527 | A * | 12/1967 | Hart | 439/588 |
| 6,042,426 | A * | 3/2000 | Byrne | 439/654 |
| 6,315,617 | B1 * | 11/2001 | Al-Sabah | 439/652 |
| 6,830,477 | B2 * | 12/2004 | Vander Vorste et al. | 439/535 |
| 6,929,514 | B1 * | 8/2005 | Chuang | 439/652 |
| 6,940,015 | B2 * | 9/2005 | Fang | 174/53 |
| 7,112,097 | B1 * | 9/2006 | Lam | 439/654 |
| 7,371,121 | B1 * | 5/2008 | Lee | 439/650 |
| 7,758,376 | B2 * | 7/2010 | Hwang et al. | 439/501 |
| 7,791,864 | B2 * | 9/2010 | Matyas et al. | 361/630 |
| 7,845,974 | B2 * | 12/2010 | Yue et al. | 439/501 |
| 7,988,494 | B2 * | 8/2011 | Lee | 439/652 |
| 8,066,523 | B1 * | 11/2011 | Wu | 439/188 |
| 8,221,131 | B1 * | 7/2012 | Mazyck | 439/13 |
| 8,585,444 | B2 * | 11/2013 | Chang | 439/651 |
| 8,625,255 | B2 * | 1/2014 | Linnane et al. | 361/611 |
| 2003/0228803 | A1 * | 12/2003 | Toering | 439/652 |
| 2009/0156061 | A1 * | 6/2009 | Bernstein | 439/652 |
| 2009/0163043 | A1 * | 6/2009 | Demers et al. | 439/43 |

* cited by examiner

*Primary Examiner* — Thanh Tam Le

(74) *Attorney, Agent, or Firm* — Muncy, Geissler, Olds & Lowe, P.C.

(57) ABSTRACT

An expandable power connector comprises a frame, a power connector disposed on the frame, and a plurality of module sets lodged in the frame. Wherein, when the module sets are assembled to the frame, a polygonal expandable power connector is contributed. Accordingly, the number of sockets on each module set can be properly arranged. Applicable space between the adjacent sockets is also increased for bulky plugs. Due to the design that each module set with at least one socket is lodged in the frame, a new module set can substitute for the old module set while the socket thereon malfunctions. Therefore, the present invention promotes the convenience of using and maintenance.

5 Claims, 9 Drawing Sheets

EXPANDABLE POWER CONNECTOR

FIELD OF THE INVENTION

The present invention relates to a design of an expandable device, particularly to an expandable power connector.

DESCRIPTION OF THE RELATED ART

As technology and economy developed, there are so many electronic appliances to be used at home or office. Computers, televisions, electric pots, electric fans, or desk lamps all need electricity, so they are provided with plugs. However, there are usually insufficient sockets on the wall of a room. Therefore, an expandable power connector is usually provided for being plugged with more electronic appliances.

Referring to FIG. 1, an expandable power connector 1 includes a long-shaped body 11, and a plurality of sockets 12 defined on the body 11 at intervals. The sockets 12 can be plugged with various electronic appliances. However, there are shortcomings existing in the current expandable power connector:

1. Referring to FIG. 2, although a certain size of applicable space is left between any two sockets 12, the dimension of a bulky plug 2 (like the one that is provided with a transformer) may easily block other sockets 12 defined at the next. Accordingly, the blocked socket 12 can not be used, which is a pity.

2. If the applicable space between any two sockets 12 is to be increased, the length of the body 11 has to be concurrently raised. However, when the length of the body 11 is raised, the dimension of the expandable power connector 1 is also augmented. Accordingly, the correlated manufacturing cost is increased, and such design of the expandable power connector does not comply with the tendency to a compact and light demand. Moreover, the massive expandable power connector lacks competitiveness in the market.

3. Further, the sockets 12 and the body 11 are integrally structured. Namely, if any one of the sockets 12 breaks down, it can not be replaced. Accordingly, fewer sockets 12 are available, which is inconvenient. And it is wasteful if the expandable power connector 1 is discarded while other sockets 12 are still endurable.

SUMMARY OF THE INVENTION

It is therefore the purpose of this invention to provide an expandable power connector that allows multiple bulky plugs to be used in the same time. Moreover, when one of the sockets breaks down, it can be replaced rapidly. Preferably, the using convenience and maintaining effect are enhanced.

The expandable power connector of the present invention comprises a frame, a power connector disposed on the frame, and a plurality of module sets lodged in the frame. The frame has a plurality of fixing members disposed thereon, corresponding to the module sets respectively. Each module set includes a body, at least one socket defined on the body, and a connecting member disposed on the body for connecting with the corresponding fixing member. The bodies of the module sets are mounted on the frame and are adjacently connected with each other, the sockets are defined on first surfaces of the bodies that are exposed to an exterior, and the first surfaces are connected and oriented with respect to each other at different inclined angles.

Preferably, the frame includes a supporting post extended therefrom.

Preferably, a safety switch is arranged on the power connector.

Preferably, a safety switch is arranged on the frame.

Preferably, a safety switch is arranged on the supporting post.

Accordingly, an appearance of the expandable power connector is a polygon, which allows the sockets to be properly arranged and increases an applicable space between any two of the sockets. Thus, even if a plug of an electronic appliance is large, the expandable power connector is suited to it. Further, the module sets along with the sockets are detachable from the frame. Therefore, when any one of the sockets breaks down, it can be directly replaced by a new unit of module set, which increases using convenience and maintaining effect.

DETAILED DESCRIPTION OF THE PREFERRED EMBODIMENTS

Figure 1:
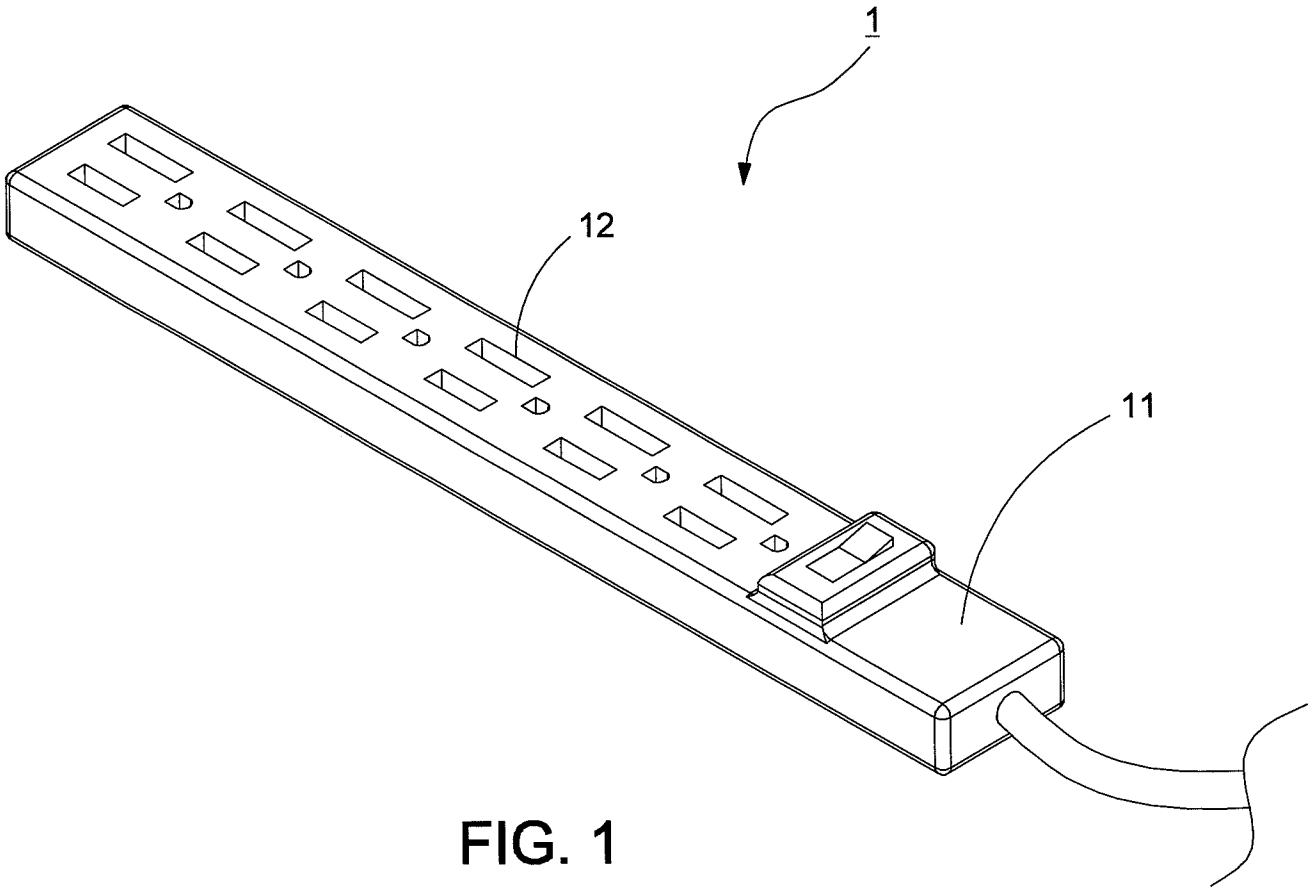
FIG. 1 (PRIOR ART)
FIG. 1 is a schematic view of a conventional expandable power connector.
Figure 2:
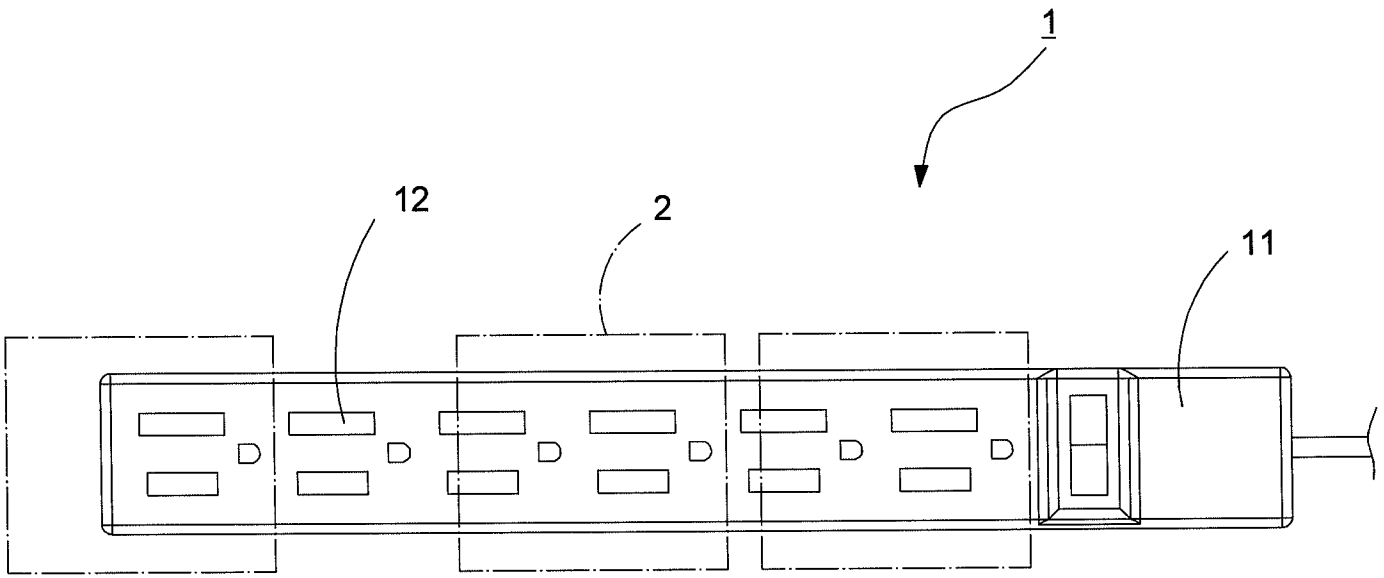
FIG. 2 (PRIOR ART)
FIG. 2 is a schematic view of the conventional expandable power connector in using.

Wherever possible, the same reference numbers are used in the drawings and the description to refer to the same or like parts.

Figure 3:
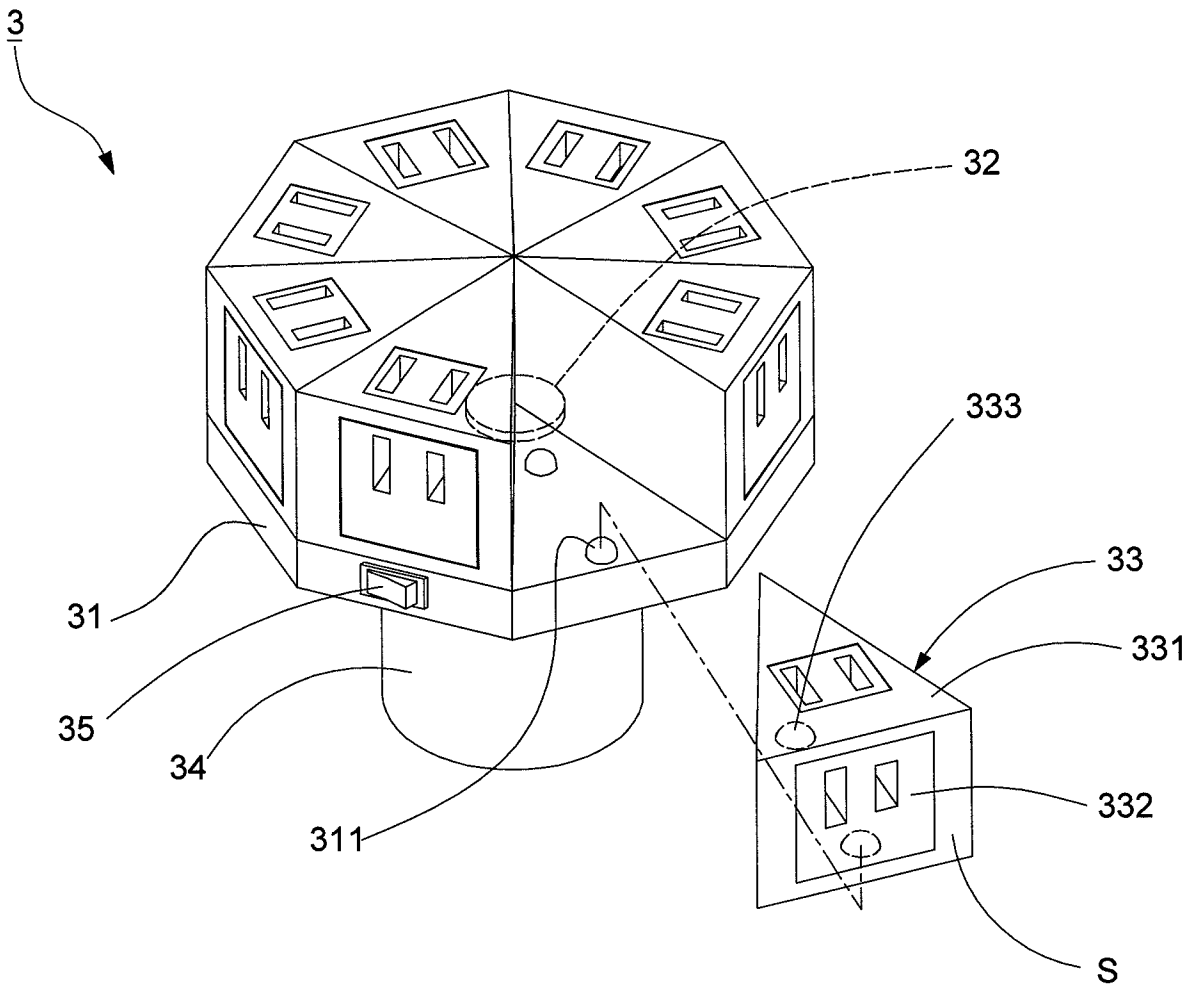
FIG. 3 is a perspective view showing a first preferred embodiment of the present invention.

Referring to FIG. 3, a first preferred embodiment of the present invention is shown. The expandable power connector 3 comprises a frame 31, a power connector 32 disposed on the frame 31, and a plurality of module sets 33 lodged in the frame 31. Wherein, the frame 31 has a plurality of fixing members 311 disposed thereon, corresponding to the module sets 33 respectively. Each module set 33 includes a body 331, at least one socket 332 defined on the body 331, and a connecting member 333 disposed on the body 331 for connecting with the corresponding fixing member 311. The bodies 331 of the module sets 33 are mounted on the frame 31 and are adjacently connected with each other, and the sockets 332 are defined on first surfaces S of the bodies 331 that are exposed to an exterior. When the bodies 331 of the module sets 33 are combined, the first surfaces S are connected and oriented with respect to each other at different inclined angles. Accordingly, an appearance of the expandable power connector 3 of the present invention shows a polygon, and in this embodiment, an octagon is presented. Further, each module set 33 includes two first surfaces S for arranging one socket 332 on each of the first surfaces S. Whereby, the expandable power connector 3 of the present invention provides larger applicable spaces for plugs (not shown).

Figure 4:
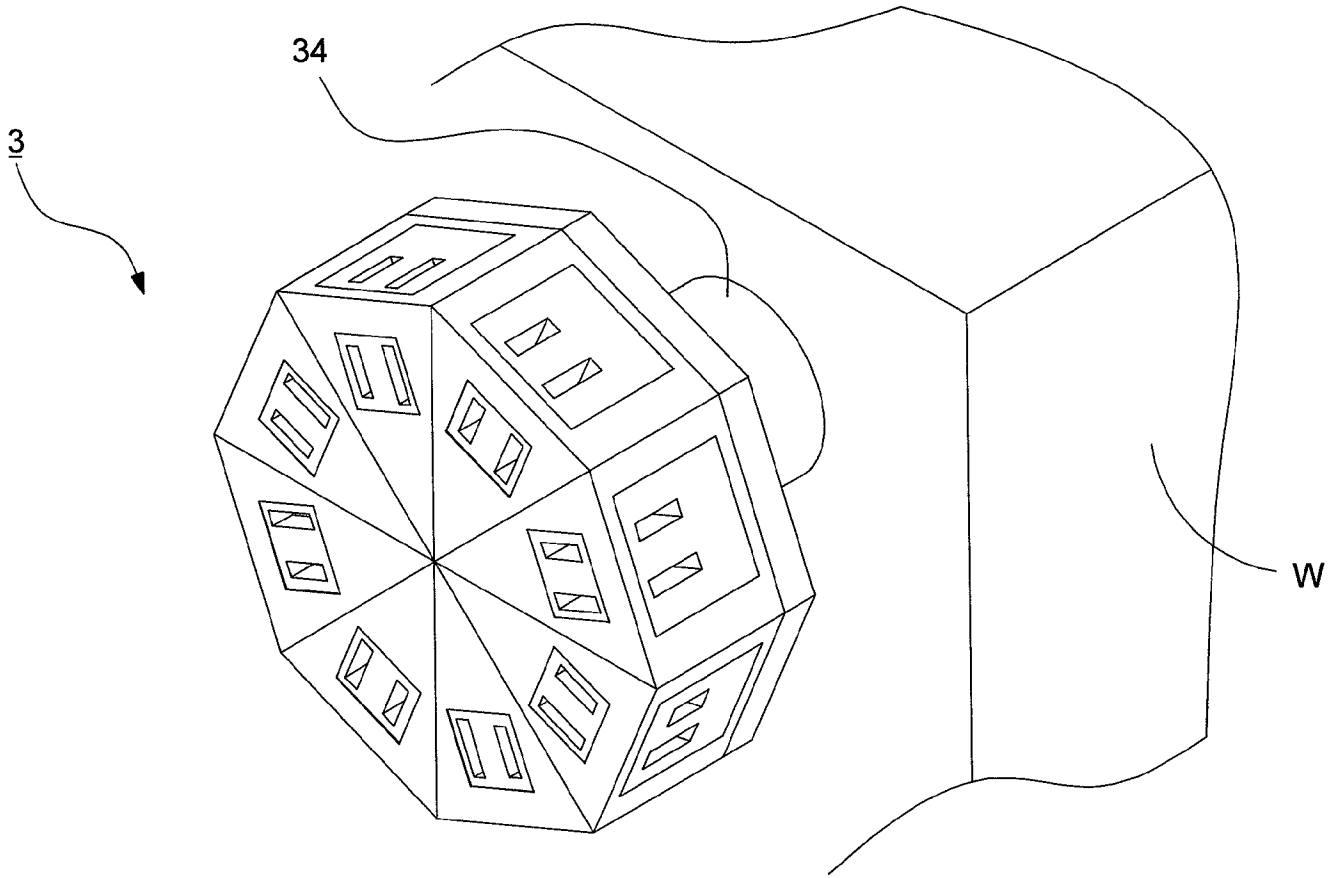
FIG. 4 is a perspective view showing another aspect of the first preferred embodiment of the present invention.

Additionally, a safety switch 35 is arranged between the power connector 32 and the sockets 332, and the safety switch 35 in this embodiment is disposed on the frame 31 for controlling the connection between the sockets 332 and the power connector 32. Further, in order to settle the expandable power connector 3 on the ground or to the ceiling or to the wall W (as shown in FIG. 4), a supporting post 34 is properly extended from the frame 31. Thereby, in the following embodiments, the supporting post 34 assists the expandable power connector 3 to be settled on the ground.

Figure 5:
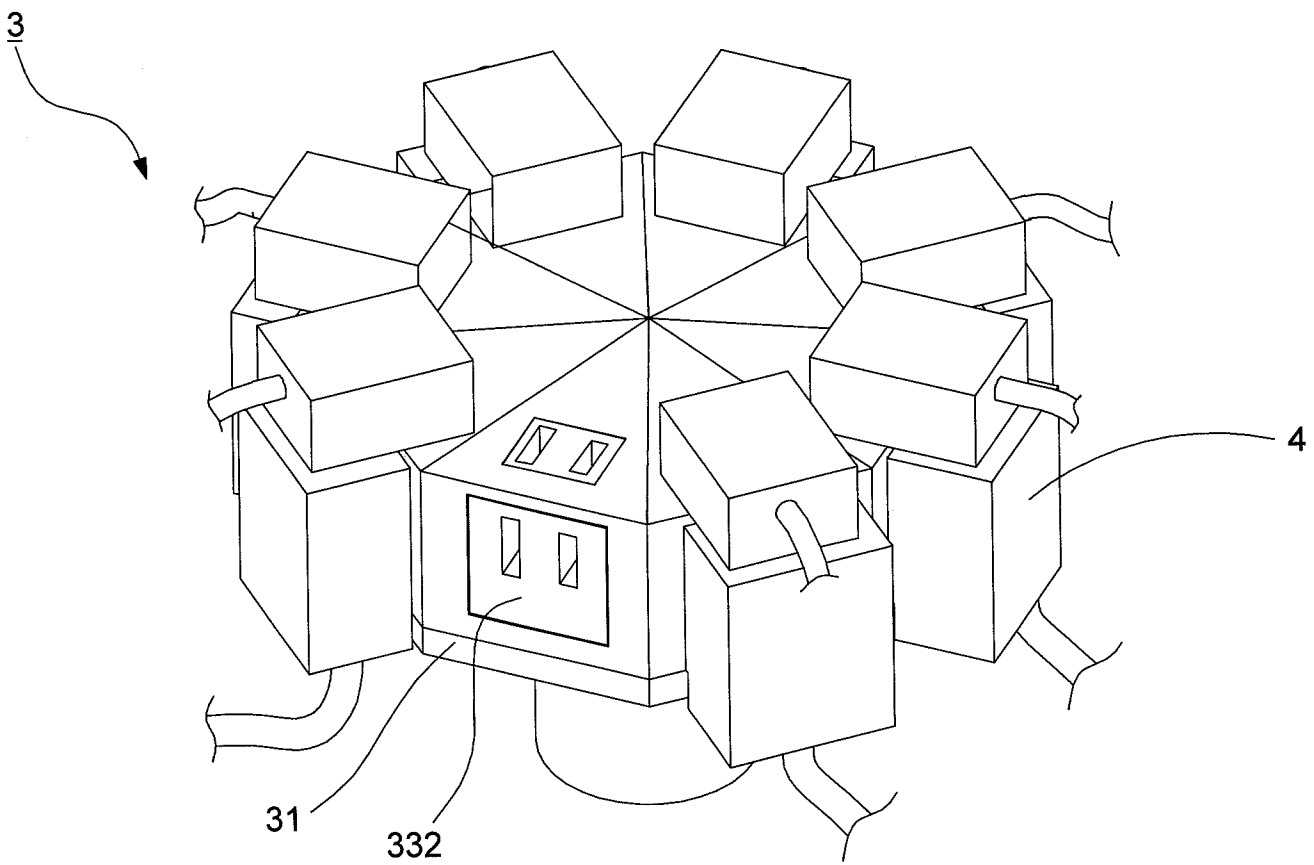
FIG. 5 is a schematic view showing the first preferred embodiment in using.

Referring to FIG. 5, when every module set 33 is combined, the first surfaces S that are abutted against each other are arranged and connected through different inclined angles. Thus, the combined module sets 33 form the polygonal appearance, and the sockets 332 are defined on the first surfaces S, so the applicable space between two adjacent sockets 332 is increased. Whereby, when several bulky plugs 4 are to be engaged in the sockets 332, their dimensions do not influence each other. Therefore, every socket 332 can cooperate with one plug 4, which increases using convenience. Moreover, since the expandable power connector 3 is formed into a polygon, the applicable spaces between the sockets 332 are increased, but the total size of the expandable power connector 3 does not have to be enlarged. Namely, while the expandable power connector 3 keeps compact, more sockets 332 are still provided for cooperating with the plugs 4, which decreases the manufacturing costs and contributes to a minimized design.

Figure 6:
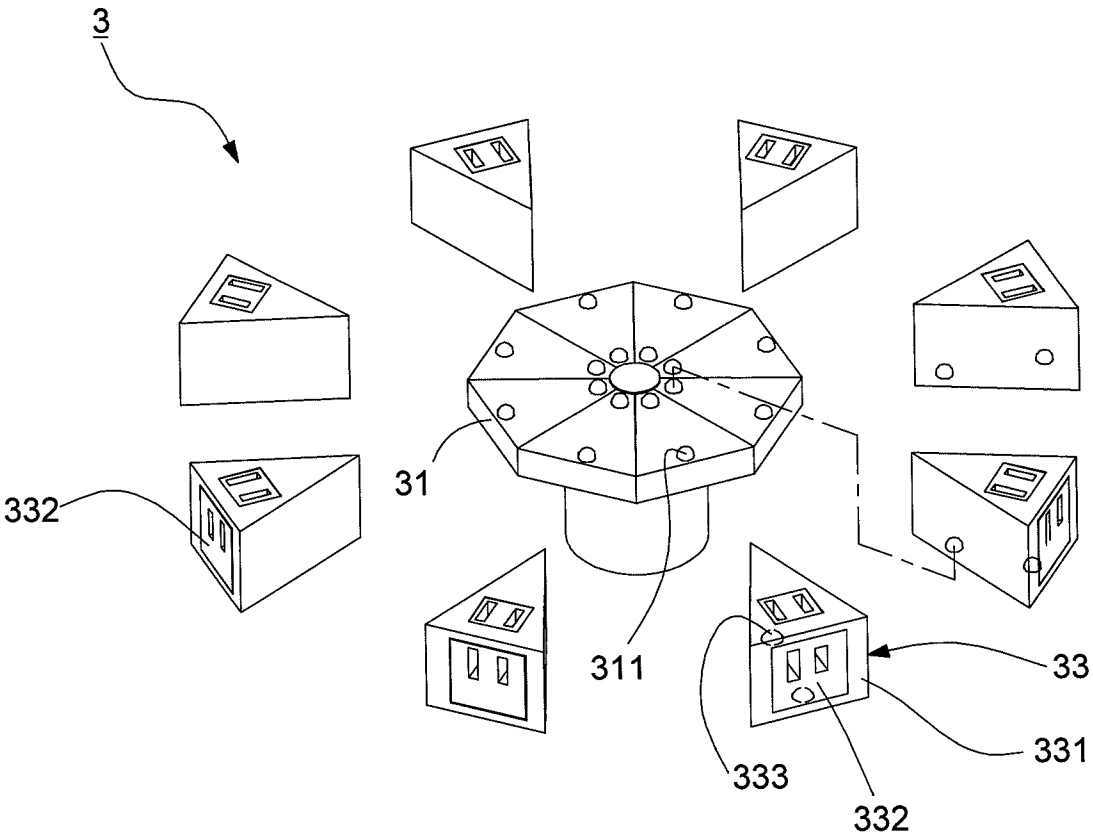
FIG. 6 is a schematic view showing the first preferred embodiment in using.

Accompanying with FIG. 6, one of the sockets 332 breaks down. Herein, every socket 332 is defined on the body 331 of the module set 33, and the module set 33 is lodged in the frame 31 and detachable from the frame 31. Thus, the socket 332 that malfunctions can be directly replaced by a new unit of the module set 33, which enhances using convenience and maintaining effect.

Figure 7:
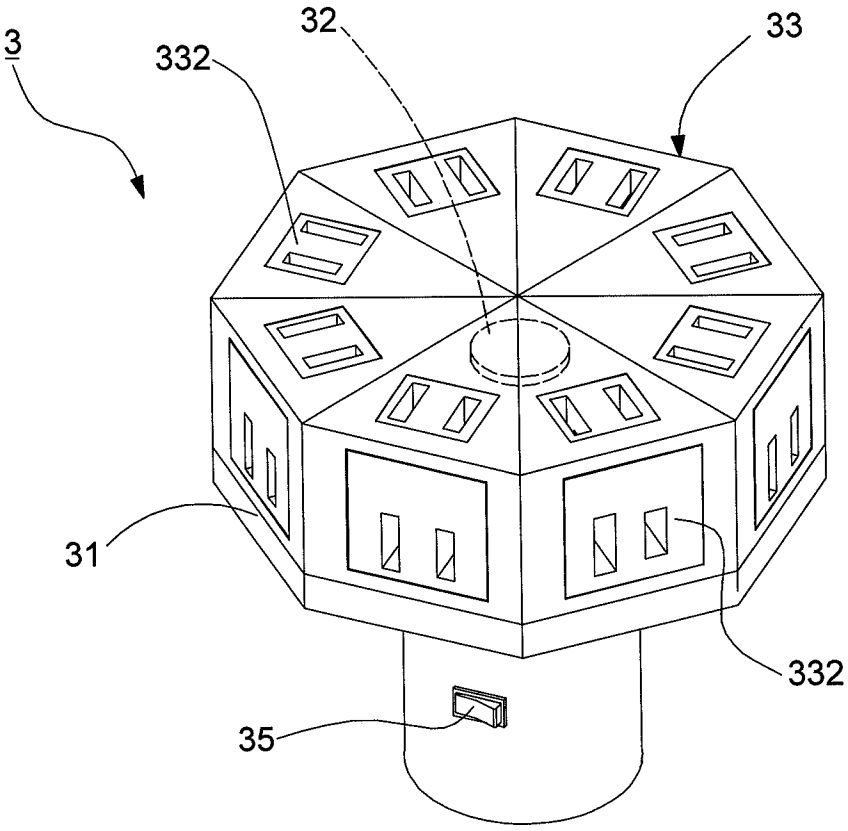
FIG. 7 is a perspective view showing a second preferred embodiment of the present invention.

Referring to FIG. 7, a second preferred embodiment of the present invention is shown. The expandable power connector 3 similarly comprises the frame 31, the power connector 32, and the module sets 33. The like correlations between elements and functions accordingly caused are herein omitted. Differently, the safety switch 35 arranged on the power connector 32 is disposed on the supporting post 34. The safety switch 35 is utilized to control the connection between the sockets 332 and the power connector 32. Namely, electricity output from the sockets 332 can be controlled, which is safer and more convenient.

Figure 8:
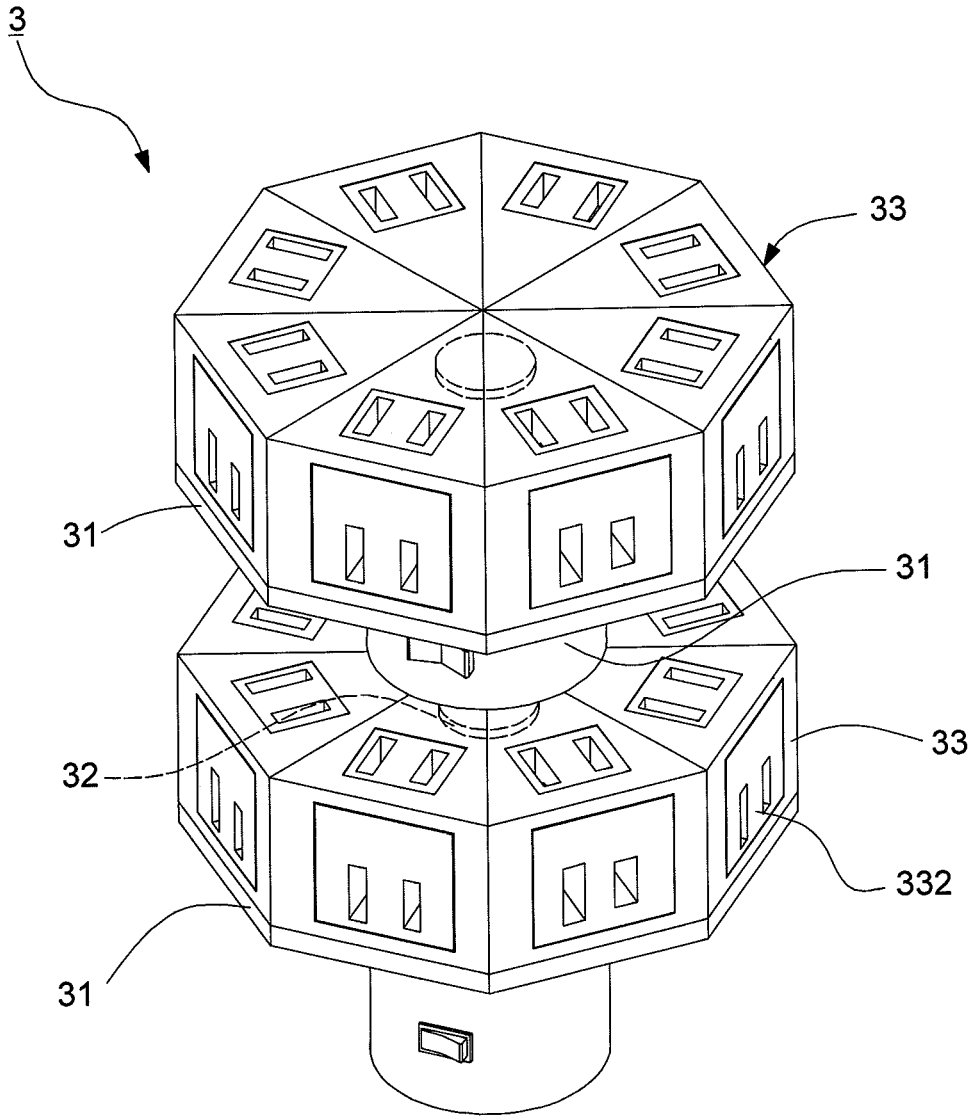
FIG. 8 is a perspective view showing a third preferred embodiment of the present invention.

Referring to FIG. 8, a third preferred embodiment of the present invention is shown. The expandable power connector 3 similarly comprises the frame 31, the power connector 32, and the module sets 33. The like correlations between elements and functions accordingly caused are herein omitted. Differently, a supporting post 34 and a frame 31 are further installed above the module sets 33. Namely, a further layer of the frame 31 is provided for being lodged with a further layer of the module sets 33. Thus, the expandable power connector 3 is able to be piled up for allowing more sockets 332 to be plugged. Preferably, the present invention can be practiced in a limited space.

Figure 9:
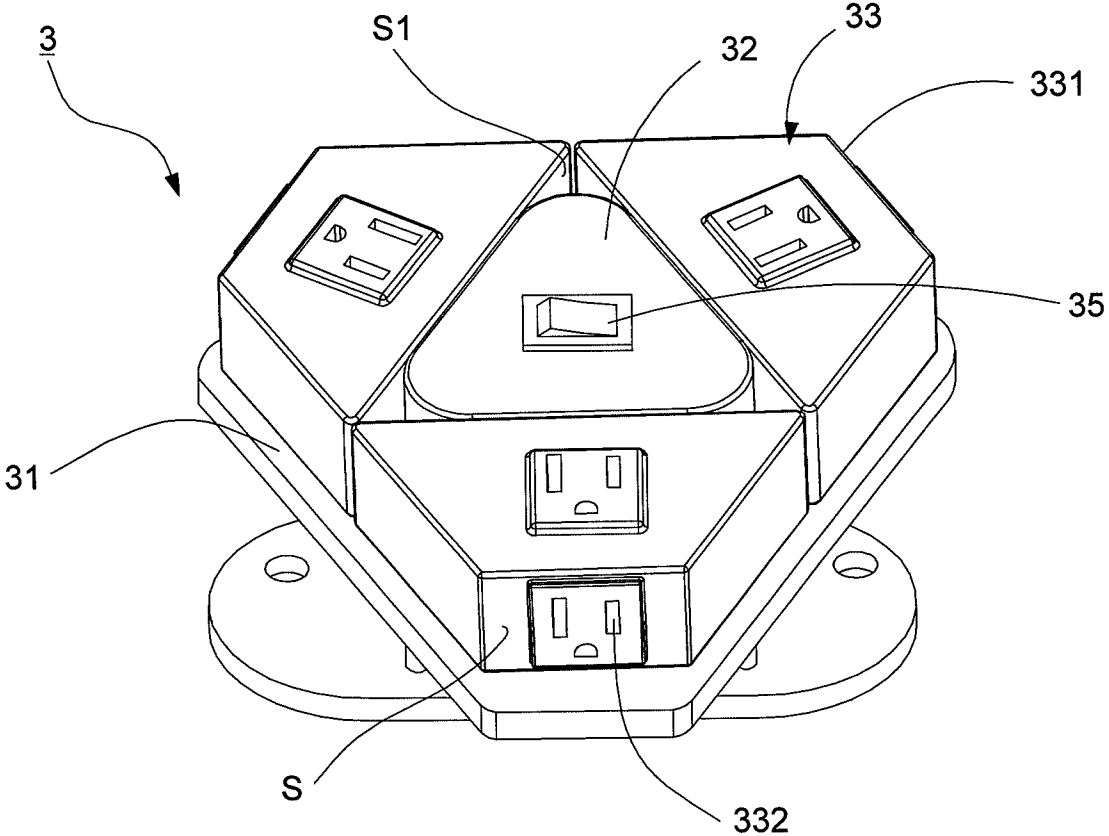
FIG. 9 is a perspective view showing a fourth preferred embodiment of the present invention.

Referring to FIG. 9, a fourth preferred embodiment of the present invention is shown. The expandable power connector 3 similarly comprises the frame 31, the power connector 32, and the module sets 33. The like correlations between elements and functions accordingly caused are herein omitted. Differently, each module set 33 is formed into a polygon. Moreover, each module set 33 includes not only the first surfaces S that are exposed to an exterior for defining the sockets 332 but also a second surface S1 that is disposed relatively to the axially arranged first surface S. Wherein, when the module sets 33 are combined, the second surfaces S1 on the module sets 33 circle a triangular space to accommodate the power connector 32. Accordingly, the applicable space between any two of the sockets 332 that are axially disposed and abutted against each other is more increased. Further, the safety switch 35 arranged on the power connector 32 is also able to control the output electricity of the sockets 332, which is evidently handy and secure.

To sum up, the present invention particularly utilizes the sockets defined on the module sets, the module sets combined on the frame, and the first surfaces of the module sets that are adjacently abutted arranged in different angles to form a polygonal expandable power connector. Thereby, the sockets will not be blocked easily because the applicable space between any two sockets is increased, so that the expandable power connector of the present invention is suited to bulky plugs. Further, the module sets together with the sockets are detachable from the frame. Therefore, when one of the sockets malfunctions, it can be detached from the frame and replaced by a new unit of the module set. Favorably, the present invention enhances using convenience and maintaining effect.

While we have shown and described the embodiment in accordance with the present invention, it should be clear to those skilled in the art that further embodiments may be made without departing from the scope of the present invention.

I claim:

1. An expandable power connector comprising:

a frame;

a power connector disposed on said frame; and a plurality of module sets lodged in said frame, wherein said frame having a plurality of fixing members disposed thereon;

wherein each module set including a body, at least one socket defined on said body, and a connecting member disposed on said body;

wherein said plurality of module sets are lodged in said frame by cooperation of said connecting members and said fixing members;

wherein said body comprising a first surface exposed to an exterior, and said socket being defined on said first surface;

wherein said body comprising a second surface connected to said first surface, and said bodies of said module sets being mounted on said frame and being connected with each other at an edge of said second surface; and wherein said first surfaces of said module sets being oriented with respect to each other with radial directions and said expandable power connector is shaped into a polygonal configuration when said bodies of said plurality of module sets are connected with each other.

2. The expandable power connector as claimed in claim 1, wherein said frame includes a supporting post extended therefrom.

3. The expandable power connector as claimed in claim 1, wherein a safety switch is arranged on said power connector.

4. The expandable power connector as claimed in claim 1, wherein a safety switch is arranged on said frame.

5. The expandable power connector as claimed in claim 2, wherein a safety switch is arranged on said supporting post.

* * * * *